US008435384B2

(12) United States Patent
Da Silva et al.

(10) Patent No.: US 8,435,384 B2
(45) Date of Patent: May 7, 2013

(54) METHOD AND APPARATUS FOR DRYING A FIBROUS WEB

(75) Inventors: Luiz C. Da Silva, Campo Limpo (BR); Thomas Scherb, Sao Paolo (BR); Peter Kahl, Gerstetten (DE); Frank Wegehaupt, Heidenheim (DE); Dieter Müller, Sontheim (DE)

(73) Assignee: Voith Patent GmbH, Heidenheim (DE)

( * ) Notice: Subject to any disclaimer, the term of this patent is extended or adjusted under 35 U.S.C. 154(b) by 329 days.

(21) Appl. No.: 12/487,310

(22) Filed: Jun. 18, 2009

(65) Prior Publication Data

US 2009/0283234 A1 Nov. 19, 2009

Related U.S. Application Data

(63) Continuation of application No. PCT/EP2007/064290, filed on Dec. 20, 2007.

(30) Foreign Application Priority Data

Dec. 22, 2006 (DE) ..... 10 2006 062 234

(51) Int. Cl.
*D21F 3/02* (2006.01)

(52) U.S. Cl.
USPC ..... 162/206; 162/358.5

(58) Field of Classification Search ..... 162/206, 162/207, 290, 297, 305, 306, 308, 312, 313, 162/314, 358.1, 358.5, 359.1, 363; 100/38, 100/118, 121, 151, 153
See application file for complete search history.

(56) References Cited

U.S. PATENT DOCUMENTS

| | | | | |
|---|---|---|---|---|
| 1,718,573 | A * | 6/1929 | Millspaugh | 162/207 |
| 1,722,503 | A * | 7/1929 | Millspaugh | 162/132 |
| 3,097,994 | A * | 7/1963 | Dickens et al. | 162/297 |
| 4,153,688 | A * | 5/1979 | Dimicoli et al. | 514/20.4 |
| 4,342,156 | A * | 8/1982 | Wanke | 34/454 |
| 4,836,894 | A * | 6/1989 | Chance et al. | 162/253 |
| 5,230,776 | A * | 7/1993 | Andersson et al. | 162/290 |
| 5,385,644 | A * | 1/1995 | Hannus et al. | 162/207 |
| 5,974,691 | A | 11/1999 | Marchal et al. | |
| 6,514,382 | B1 * | 2/2003 | Kakiuchi et al. | 162/109 |
| 6,869,506 | B2 * | 3/2005 | Jewitt | 162/207 |
| 6,953,516 | B2 * | 10/2005 | Hermans et al. | 162/198 |
| 7,442,279 | B2 * | 10/2008 | Hermans et al. | 162/118 |
| 7,744,726 | B2 * | 6/2010 | Scherb et al. | 162/205 |
| 2004/0118546 | A1 * | 6/2004 | Bakken et al. | 162/348 |
| 2005/0056392 | A1 * | 3/2005 | Anderson | 162/199 |
| 2005/0155734 | A1 * | 7/2005 | Hermans et al. | 162/198 |
| 2005/0167061 | A1 * | 8/2005 | Scherb et al. | 162/115 |
| 2005/0167062 | A1 * | 8/2005 | Herman et al. | 162/115 |
| 2005/0167066 | A1 * | 8/2005 | Herman et al. | 162/203 |

FOREIGN PATENT DOCUMENTS

| | | | |
|---|---|---|---|
| EP | 1852551 | A1 | 11/2007 |
| WO | 2005073461 | A1 | 8/2005 |
| WO | 2005075737 | A1 | 8/2005 |

* cited by examiner

*Primary Examiner* — Mark Halpern
(74) *Attorney, Agent, or Firm* — Taylor IP, P.C.

(57) ABSTRACT

A method for drying a fibrous web, particularly a paper, cardboard or tissue web whereby the moving fibrous web is treated with got air in the area of a pre-definable drying zone the fibrous web is treated, at least in some areas inside the drying zone with steam.

79 Claims, 4 Drawing Sheets

Steam Shower

PRIOR ART

Hot Air Hood

PRIOR ART

METHOD AND APPARATUS FOR DRYING A FIBROUS WEB

CROSS REFERENCE TO RELATED APPLICATIONS

This is a continuation of PCT application No. PCT/EP2007/064290, entitled "METHOD AND APPARATUS FOR DRYING A FIBROUS WEB", filed Dec. 20, 2007, which is incorporated herein by reference.

BACKGROUND OF THE INVENTION

1. Field of the Invention

The invention relates to a method for drying a fibrous web, especially a paper, cardboard or tissue web, whereby the moving fibrous web is treated with hot air in the area of a pre-definable drying zone. It further relates to a corresponding drying apparatus as well as to a machine for the production of a tissue web with such a drying apparatus.

2. Description of the Related Art

A method which serves to produce a voluminous tissue web and in which a so-called belt press in conjunction with a hot air hood or, alternatively a steam hood is utilized to dewater a fibrous web to a certain dry content is already known from WO 2005/075737 A1. With tissue machines it is important to reduce the energy consumption especially during the drying process in order to achieve a pre-determinable dry content. There is also a requirement to increase the dry content at reduced energy consumption.

What is needed in the art is an improved method, as well as an improved apparatus for the drying process for the production of a tissue web, which is optimized, especially in consideration of the energy requirement for dewatering the tissue web.

SUMMARY OF THE INVENTION

Regarding the method of the present invention, the fibrous web is treated, at least in some areas, with steam inside the drying zone. Accordingly, hot air and steam are used in combination together for drying the fibrous web, preferably a tissue web. The fibrous web is advantageously treated with steam within the first half of the total drying zone length, when viewed in the direction of web travel. In this arrangement the fibrous web is treated with steam, at least at the beginning of the drying zone, when viewed in the direction of web travel.

Viewed in the direction of web travel, the fibrous web can initially be treated with steam and subsequently with hot air. According to an alternative practical arrangement it is also possible to treat the fibrous web, when viewed in direction of web travel, initially with hot air, subsequently with steam and then again with hot air.

In certain instances it is advantageous if the fibrous web, viewed in the direction of web travel, is treated at least essentially over the entire length of the drying zone with steam.

According to an alternative practical arrangement of the inventive method it is also possible to treat the fibrous web with steam, at least essentially only within the first half of the total length of the drying zone when viewed in direction of web travel. In this case the fibrous web is treated with steam, preferably at least essentially over only the first half of the total length of the drying zone, viewed in the direction of web travel.

According to an additional advantageous arrangement the fibrous web is treated with steam, at least essentially only within the first third of the total length of the drying zone, and moreover preferably at least essentially over this first third, viewed in the direction of web travel.

In certain cases it is also advantageous if the fibrous web is treated with steam, at least essentially only within the first quarter of the total length of the drying zone, and moreover hereby preferably at least essentially over this first quarter, viewed in the direction of web travel.

According to an additional alternative arrangement of the inventive method the fibrous web is treated with steam only at the beginning of the drying zone, viewed in the direction of web travel.

In another embodiment of the present invention the fibrous web is treated with hot air over the pre-determinable drying zone. At least in this instance the drying zone can be defined, at least essentially through the area in which the fibrous web is treated with hot air. In this case the fibrous web may be treated with steam, particularly inside and/or prior to this drying zone.

The fibrous web is advantageously treated at least in some areas simultaneously with hot air, as well as with steam, viewed in the direction of web travel. Under simultaneous treatment it is to be understood that a respective area of the fibrous web is treated with hot air, as well as also with steam.

According to a useful practical arrangement of the present invention the fibrous web can be carried through the drying zone together with a permeable fabric, especially a structured fabric or a TAD-fabric (TAD=Through Air Drying). In this case, hot air or steam, which has not condensed in the web, flow initially through the fibrous web, and subsequently through the permeable fabric. The inventive combined hot air and steam treatment can therefore also be used, in a TAD drying process.

Another embodiment of the present invention distinguishes itself in that the fibrous web, together with at least one permeable fabric, especially a structured fabric is guided through the drying zone, whereby hot air or steam flow initially through the permeable fabric and subsequently through the fibrous web.

In the drying zone the fibrous web can be covered advantageously by at least one additional permeable fabric, especially a press belt, whereby in this case hot air or steam flow initially through the additional permeable fabric or press belt, subsequently through the first permeable fabric or structured fabric and finally through the fibrous web. Moreover, in the use of a press belt a type of belt press is created through which, in addition to the mechanical pressure, the inventive combined hot air and steam drying process is applied.

A dewatering fabric, especially a felt can additionally be run through the drying zone together with the fibrous web, whereby hot air or steam, as far as this has not condensed on the web, as previously mentioned, initially flow through the additional permeable fabric or press belt, subsequently through the first permeable fabric or structured fabric and the fibrous web and finally through the additional dewatering fabric.

It is also conceivable to subject the fibrous web in the drying zone, at least in some areas, to impingement drying. In this scenario the inventive combined hot air and steam application is used within the scope of such an impingement drying. The fibrous web may be subjected, at least in some areas, also to through-air drying.

An objective of the invention is not inventively by an apparatus for drying a fibrous web, especially a paper, cardboard or tissue web, including a drying zone where the moving fibrous web is treated with hot air and whereby this apparatus is characterized in that the fibrous web can be treated with steam, in at least some areas inside the drying zone.

For the treatment of the fibrous web with hot air, at least one hot air hood is provided. In this arrangement the drying zone can be defined particularly through the dimensions of the hot air hood. A steam treatment of the fibrous web is advantageously contemplated inside and/or especially before the drying zone.

At least one steam blow device, especially a steam blow pipe or steam blow box, is advantageously provided for the treatment of the fibrous web with steam.

The steam blow device extends advantageously at least essentially over the entire width of the hot air hood as measured across the direction of web travel. It is also especially advantageous if the steam blow device is located, at least partially, inside the hot air hood. According to one embodiment of the present invention the steam blow device may also be located directly before the hot air hood, viewed in the direction of web travel.

The steam blow device can moreover be arranged, designed and/or controlled so that the fibrous web, viewed in the direction of web travel, is treated simultaneously with hot air as well as with steam over only a part of the total length of the drying zone or over the entire drying zone.

If the steam blow device includes a steam blow pipe, then the diameter of the orifice of this steam blow pipe is in a range of approximately 5 to approximately 1 mm, and preferably in a range of approximately 4 to approximately 2.5 mm. The diameter preferably has an upper limit, since a certain speed is necessary for the steam jet.

If the fibrous web is covered by at least one permeable fabric, for example a permeable press belt in the area of the drying zone, then the distance between the steam blow device and the outer permeable fabric, for example a press belt, covering the fibrous web is <30 mm, especially <20 mm, particularly <15 mm and preferably ≦10 mm.

If the steam blow device includes a steam blow pipe its orifices can be advantageously located from each other at a distance of <20 mm, particularly <10 mm and preferably <7.5 mm.

If the steam blow device includes at least one steam blow box, the moisture profile of the fibrous web can advantageously be adjusted and/or regulated through it.

If the steam blow device includes at least one steam blow pipe, the dry content of the fibrous web can be influenced or adjusted and/or regulated at least essentially through this steam blow pipe.

In principle the steam blow device may include only at least one steam blow box or only at least one steam blow pipe, or at least one steam blow box as well as at least one steam blow pipe.

If the fibrous web is covered by at least one permeable fabric in the area of the drying zone, a device such as a doctor blade or similar devices are advantageously provided in order to remove the boundary layer of air that is carried along by the outer permeable fabric which covers the fibrous web before the fabric enters the drying area.

The hot air for the hot air hood in the drying zone can be taken, at least partially, from the hood allocated to a drying cylinder, especially a Yankee-Cylinder. Energy recovery of this type is possible since the temperature of the exhaust air of such a hood allocated to a Yankee-Cylinder is very much higher than the temperature that is necessary for the hot air to supply the hot air hood in the drying zone. The temperature of the hot air taken from the hood of a drying cylinder, specifically a Yankee-Cylinder can, for example, be approximately 300° C.

The hot air hood in the dryer zone is supplied, at least partially, with hot air whose temperature is in a range of <250° C., especially <200° C. and preferably in a range of approximately 150° C. to approximately 200° C.

The temperature of the hot air for the supply of the hot air hood can be accordingly adjustable and/or controllable for optimization of the operating point with regard to the energy consumption. As a rule, a higher temperature does not result in a more efficient drying.

According to another embodiment of the present invention at least one suction equipped device, especially a suction box and/or suction roll, is located in the area of the drying zone, on the side of the fibrous web or the additional dewatering fabric facing away from the hot air hood. Moreover, the suction equipped device may include a suction roll with a suction box that defines a suction zone.

As already mentioned, a belt press is created by an additional permeable fabric in the form of a press belt that is under tension. To this end the press belt is subjected to a high tension in the range of approximately 40 to approximately 60 kN/m, in order to exert a pressing pressure in the range of approximately 0.5 to approximately 1.5 bar in a press zone. It is also especially advantageous if the length of the press zone, viewed in the direction of web travel, which is formed by the permeable press belt 80, is defined by the area of the wrap over which the press belt wraps around the suction roll.

The length of the press zone, viewed in direction of web travel, which is formed by the permeable press belt, can correspond also to the length of the suction zone or respectively the suction box of the suction roll.

The drying zone viewed in direction of web travel can be shorter than the press zone. In certain instances it is however also advantageous if the drying zone, viewed in direction of web travel, is the same length as, or longer than the press zone.

The throughput volume (1/min.) of steam is preferably less than the throughput volume (1/min.) of hot air. Moreover, at atmospheric pressure the throughput volume of steam can advantageously be less than 0.5 times, especially less than 0.3 times and preferably less than 0.2 times the throughput volume of hot air.

The steam causes an increase in the temperature of the fibrous web in order to reduce the viscosity of the water in the fibrous web. To that end the steam in the fibrous web, especially the tissue web must condense so that the appropriate temperature increase can be achieved. This temperature increase may, for example, be adjusted through an appropriate selection of the correct temperature level for the hot air. Preferably the temperature of the hot air treating the fibrous web is adjustable, especially for the purpose of influencing the condensation of the steam in the fibrous web.

If the temperature is too low the steam condenses immediately prior to entering the fibrous web. This is due to the fact that the steam is cooled by the housing of the hot air hood and by the incoming colder fabrics. This could occur especially when using a so-called belt press, since the steam in this case must penetrate two outer fabrics, the outer permeable fabric, in particular the press belt and possibly a permeable structured fabric, before it enters the fibrous web.

If the fibrous web is covered by a permeable press belt in the drying zone, then this arrangement advantageously has a permeability of >100 cfm, especially >300 cfm, particularly >500 cfm and preferably >700 cfm.

If the fibrous web is carried through the drying zone together with a permeable structured fabric, then this arrangement preferably has a permeability of >100 cfm, especially 300 cfm, particularly 500 cfm and preferably >700 cfm.

It is also especially advantageous if the fibrous web is covered in the drying zone by a permeable press belt which consists at least essentially of a synthetic material, especially polyamide, polyethylene, polyurethane, etc.

According to another embodiment of the present invention the fibrous web can also be covered in the drying zone by a permeable press belt which is formed be a metal fabric. Preferably at least one fabric, which runs through the drying zone together with the fibrous web, is pre-heated before the drying zone, viewed in the direction of web travel. This is especially advantageous in the case where a press belt consisting of metal is used.

For pre-heating a steam heating device, an IR heating device and/or a hot water heating device may used. A hot water heating device is advantageous for an inner fabric, such as an additional dewatering fabric that runs through the drying zone together with the fibrous web.

As already mentioned the boundary layer of air that is carried along on the surface of the outer fabric can advantageously be removed by a doctor blade which is located before the hot air hood and which extends across the width of the hot air hood. This also causes an accordingly higher temperature since the cooling of the steam is avoided prior to entering the fibrous web. Therefore, a lower hot air temperature can be selected.

The current invention also relates to a machine for the production of a tissue web which is characterized in that it includes an inventive drying apparatus.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
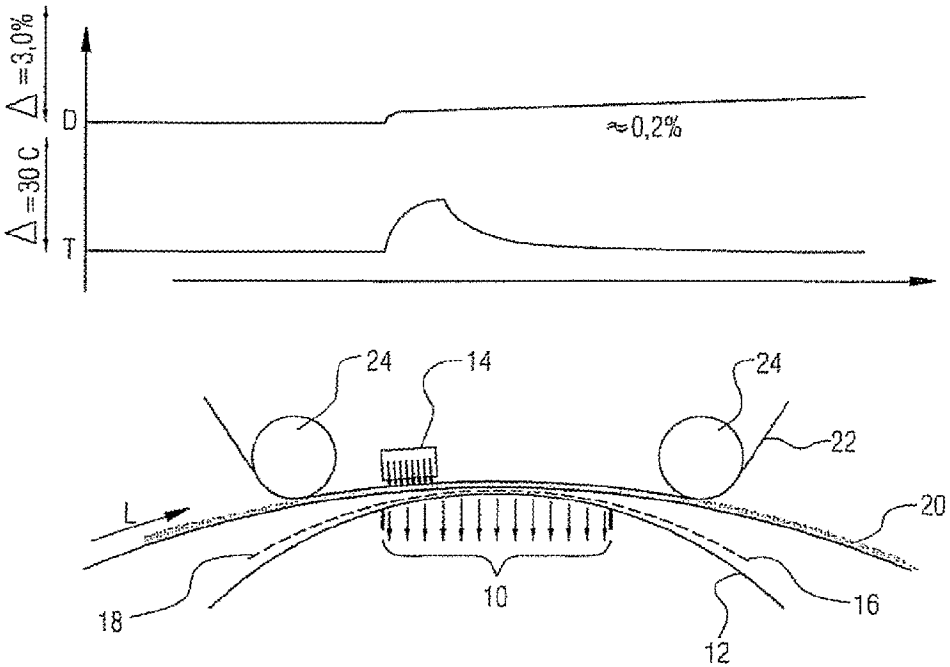
FIG. 1 is a schematic depiction of a conventional drying apparatus which operates with steam only, as well as of the corresponding dry content increase and the corresponding temperature progression.

Referring now to the drawings, and more particularly to FIG. 1, there is shown a schematic depiction of a conventional drying apparatus which operates with steam only and includes one suction roll 12 with a suction zone 10, and one steam blow box 14 in the initial area, opposite suction zone 10. The tissue web 16 is carried over suction roll 12 between an inside dewatering fabric 18 or felt and a structured fabric 20, together with an outside press belt 22 which, in this example is metal. Fabrics 18 through 20 respectively are permeable. Press belt 22 is carried over guide rolls 24 and in the area of suction zone 10, presses fabrics 18 through 22, as well as tissue web 16 against suction roll 12.

The temperature T increases in the area of steam blow box 14. Subsequently tissue web 16 cools off drastically inside suction zone 10, with the taken in ambient air. As seen in FIG. 1, a dry content increase of approximately 0.2% occurs, however only in the area of steam blow box 14.

Figure 2:
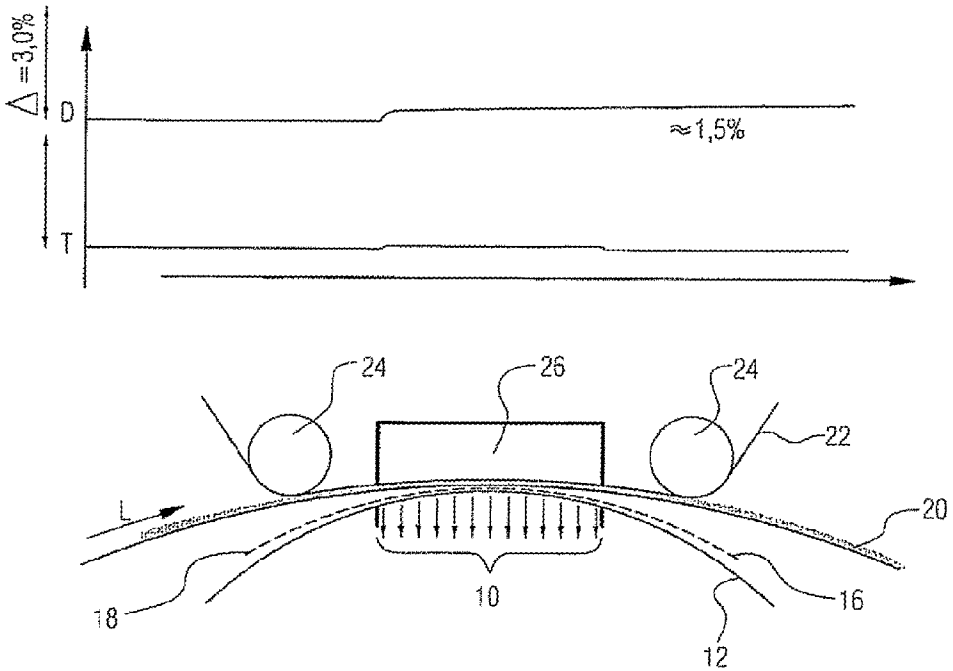
FIG. 2 is a schematic depiction of a conventional drying apparatus which operates only with hot air, as well as of the corresponding dry content increase and the corresponding temperature progression.

Now, additionally referring to FIG. 2 there is shown a schematic depiction of a conventional drying apparatus which operates with hot air only. This drying apparatus includes a suction roll 12 with a suction zone 10 and a hot air hood 26 opposite suction zone 10, which extents across its entire width when viewed in the direction of web travel L. Tissue web 16 is again carried over suction zone 10 of suction roll 12 between a permeable dewatering fabric 18 or felt and a permeable structured fabric 20, together with an outside permeable metal press belt 22. With this drying apparatus in which tissue web 16 is dried by hot air flowing through it the dry content increase D amounts to approximately 1.5%. The temperature T increases only insignificantly in the area of the suction zone 10 and hot air hood 26.

Figure 3:
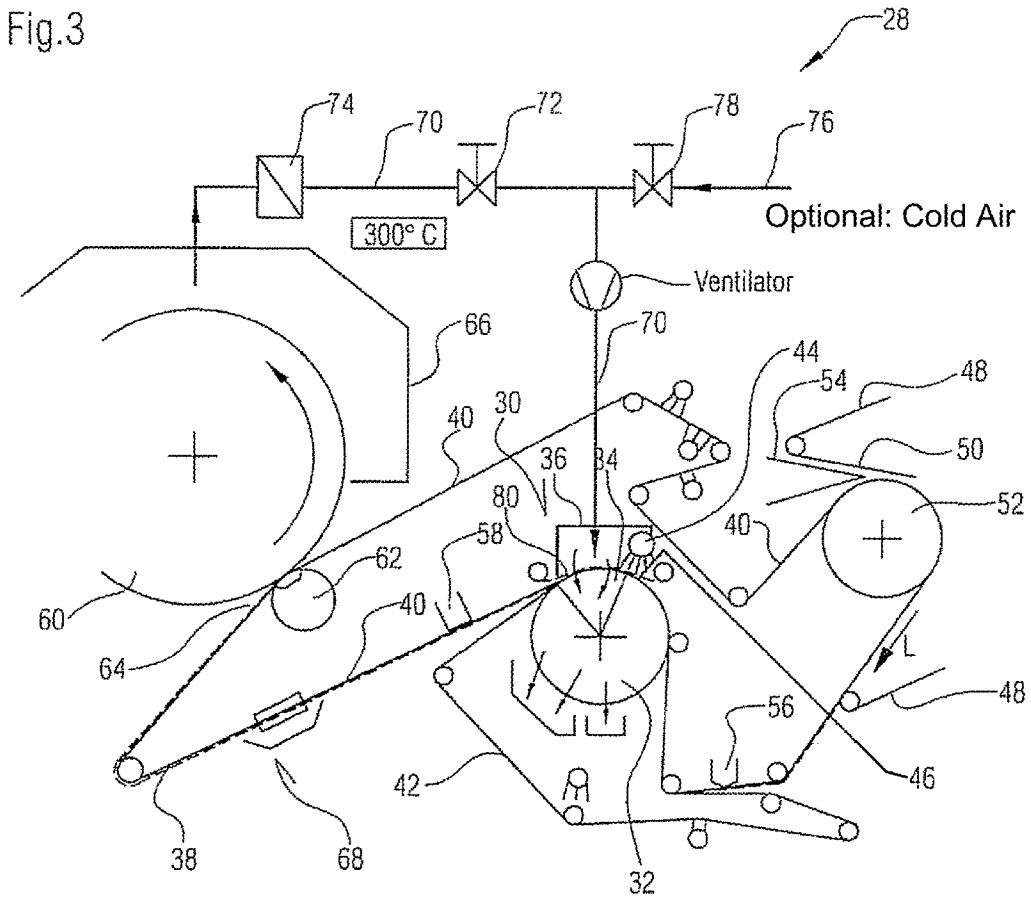
FIG. 3 is a schematic depiction of an embodiment of a machine for the production of a tissue web, including a drying apparatus of the present invention.

Now, additionally referring to FIG. 3 there is shown a schematic depiction of an embodiment of the present invention in the form of machine 28 for the production of a fibrous web, in this case, for example, a tissue web, with an apparatus 30. Drying apparatus 30 includes a suction roll 32 with a suction zone 34, which is defined by an integrated suction box, and a hot air hood 36, which is allocated to suction roll 32.

Fibrous web 38 is carried over suction roll 32 together with a permeable structured fabric 40, whereby fibrous web 38 is located between permeable structured fabric 40 and suction roll 32. A permeable press belt 80, which is under high pressure, is wrapped around suction roll 32 on the outside in the area of suction zone 34, thereby creating a belt press 80. Press belt 80 which is merely indicated in FIG. 1 is more clearly recognizable in FIG. 4. The hot air flows from hot air hood 36 successively through permeable press belt 80, permeable structured fabric 40 and fibrous web 38 into suction zone 34 of suction roll 32.

In addition, dewatering fabric 42, for example felt which is located between suction roll 32 and permeable structured fabric 40 and through which the hot air flows into suction zone 34 of suction roll 32, can be guided around suction roll 32. In the present example therefore the hot air flows successively through permeable press belt 80, permeable structured fabric 40, fibrous web 38 and dewatering fabric 42.

Moving fibrous web 38 is treated with hot air by a drying zone, whereby this drying zone can be defined by a hot air hood 36. Moreover, this drying zone can extend, at least essentially over suction zone 34 of suction roll 32, or for example also beyond it, viewed in the direction of web travel L.

According to the present invention fibrous web 38 is now treated with hot air in the area of this drying zone, and at least in some areas with steam.

To this end fibrous web 38 may be treated with steam at least at the beginning of the drying zone, viewed in direction of web travel L. In the present example according to FIG. 3 and viewed in direction of web travel L, fibrous web 38 is treated only at the beginning of this drying section with steam. Viewed in direction of web travel it is initially treated with steam and subsequently with hot air.

At least one steam blow pipe or steam blow device 44, such as a steam blow pipe or steam blow box is provided for treatment of fibrous web 38 with steam. In the present example this steam blow device 44 includes a steam blow pipe, located preferably at the beginning of the drying zone.

The steam blow device 44 can extend across the entire width of hot air hood 36, measured across the direction of web travel L. Advantageously it is located at least partially inside hot air hood 36.

Figure 4:
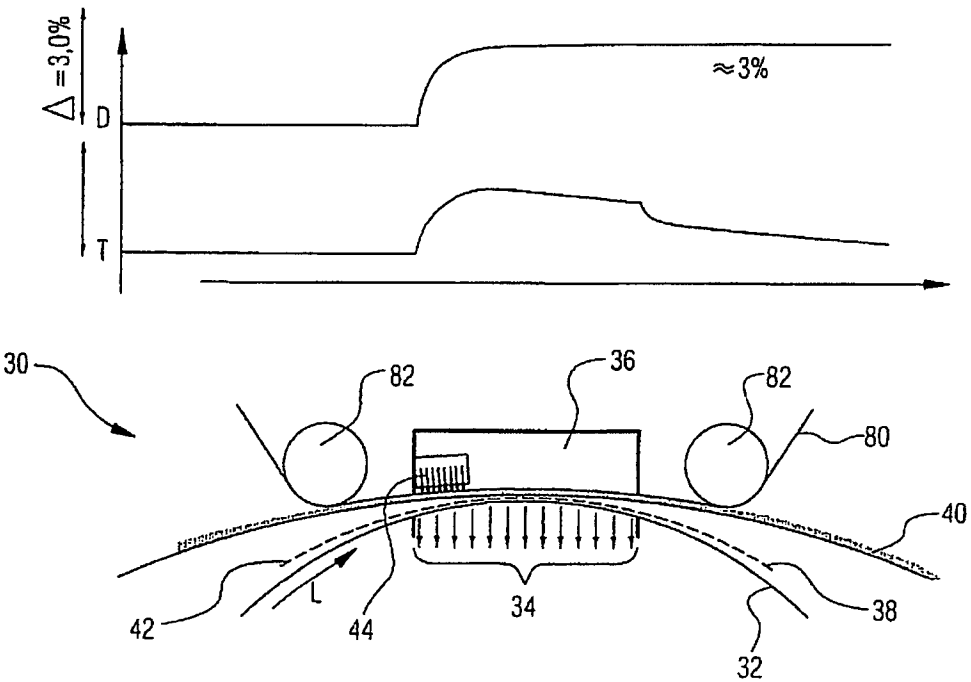
FIG. 4 is a simplified schematic depiction of a drying apparatus, as well as of the corresponding dry content increase and the corresponding temperature progression of the present invention.

As can be seen in the example depicted in FIG. 4, steam blow device 44 may also include, at least one steam blow box 44. In this case too steam blow box 44 is located again at the beginning of the drying zone which is defined by hot air hood 36 and is located inside hot air hood 36. Therefore, in this arrangement too, fibrous web 38 is initially treated with steam and subsequently with hot air.

As can be seen in FIG. 3, a device such as a doctor blade 46 or similar devices can be provided in order to remove the boundary layer of air which is carried along by outer permeable structured fabric 40 covering fibrous web 38, before fabric 40 enters into the drying zone.

In addition machine 28 includes a former with two dewatering fabrics 40 and 48 running together, whereby in the existing example the inside fabric is the permeable structured fabric 40. The two dewatering fabrics 40 and 48 run together, thereby forming a stock infeed nip 50 and are carried over a forming element 52, especially a forming roll 52.

In the existing example permeable structured fabric 40 is in the embodiment of the inside dewatering fabric of the former, which is in contact with forming element 52. Outside dewatering fabric 48 which is not in contact with forming element 52 is separated again from fibrous web 38 subsequent to forming element 52.

The fibrous stock suspension is fed into the stock infeed nip 50 by way of a headbox 54.

A suction element 56 is provided between forming element 52 and drying apparatus 30, through which fibrous web 38 is held on permeable structured fabric 40 or, respectively is pressed against permeable structured fabric 40.

After drying apparatus 30, dewatering fabric 42 is again separated from permeable structured fabric 40. Moreover, a pickup or separation element 58 is provided after drying apparatus 30 through which fibrous web 38 is held to permeable structured fabric 40 during the separation from dewatering fabric 42.

Subsequent to this fibrous web 38, together with permeable structured fabric 40, is run through a press nip 64 which is formed preferably by a drying cylinder 60 in the embodiment of a Yankee-Cylinder 60 and a press element 62, for example a press roll 62. In the present arrangement press element 62 is for example a shoe press roll 62. Following press nip 64 permeable structured fabric 40 is separated again from drying cylinder 60 while fibrous web 38 remains on drying cylinder 60. A hood 66 is allocated to drying cylinder 60.

A vacuum box with a hot air hood 68 or similar device can optionally be provided between suction roll 32 and drying cylinder 60, in order to increase the sheet rigidity.

The hot air for hot air hood 36 which is allocated to suction roll 32 can be taken at least partially from hood 66 which is allocated to drying cylinder 60. The hot air taken from hood 66 has a temperature in the range of approximately 300° C. which, as a rule is higher than is required for the hot air of hot air hood 36.

As can be seen in FIG. 3 the hot air taken from hood 66 which is allocated to drying cylinder 60 can be supplied to hot air hood 36 via a supply line 70 in which at least one valve 72, especially a control valve can be located. In addition a filter 74 may also be provided, if required, in this supply line 70 for the removal specifically of short fibers, dust or similar substances. Finally, a ventilator may also be located in supply line 70.

The hot air taken from hood 66 which is allocated to cylinder 60 can also be mixed with cold air that is supplied through a line 76. Also in line 76 a valve 78, especially a control valve, can be provided for the cold air that is to be supplied. The temperature of the air supplied to hot air hood 36 can therefore be adjusted through the mixing ratio of the hot air taken from hood 66 and the cold air.

FIG. 4 shows a simplified depiction of a modified design variation of the inventive drying apparatus 30. As already mentioned, in this arrangement steam blow device 44 includes a steam blow box 44 located at least essentially inside hot air hood 36, in place of the steam blow pipe. Viewed in direction of web travel L steam blow box 44 is located at the beginning of the drying zone which is defined here at least essentially by hot air hood 36.

The present example distinguishes itself from that in FIG. 3 moreover in that in addition to the permeable structured fabric 40 and the dewatering fabric 42 or felt a permeable press belt 80 is routed through the drying zone together with the fibrous web 38, by way of which permeable structured fabric 40, fibrous web 38 and permeable dewatering fabric 42 are pressed against the suction roll in the area of suction zone 34.

Viewed in direction of web travel L press belt 80 is routed around a guide roll 82 before and after the drying zone respectively through which the appropriate tension for press belt 80 is produced.

As can be seen in FIG. 4, a relatively high temperature T results opposite the entire suction zone which in this arrangement, also defines the drying zone. Correspondingly, a relatively high dry content increase also occurs—in this instance approximately 3%.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for drying a fibrous web, the web being one of a paper web, a cardboard web and a tissue web, the moving fibrous web being treated with hot air in an area of a predefined drying zone, the method comprising the steps of:

covering the fibrous web with at least one permeable fabric before said at least one permeable fabric enters the drying zone;

removing an air boundary layer with a doctor blade before said at least one permeable fabric enters the drying zone, the air boundary layer being carried along by said at least one permeable fabric before being removed; and treating in at least some areas the fibrous web first with steam inside the drying zone then subsequently with hot air in a direction of web travel, the fibrous web being treated with steam within a first half of a total length of the drying zone in said direction of web travel, the fibrous web being treated with steam at least at a beginning of the drying zone relative to said direction of web travel, the drying zone being defined by a hot air hood.

2. The method of claim 1, wherein the fibrous web is additionally treated substantially over the entire length of the drying zone with steam as viewed in a direction of web travel.

3. The method of claim 2, wherein the fibrous web is treated with steam substantially only within the first half of a total length of the drying zone as viewed in said direction of web travel.

4. The method of claim 3, wherein the fibrous web is treated with steam substantially over the first half of the total length of the drying zone as viewed in said direction of web travel.

5. The method of claim 1, wherein the fibrous web is treated with steam only within a first third of the total length of the drying zone as viewed in said direction of web travel.

6. The method of claim 5, wherein the fibrous web is treated with steam substantially over the first third of the total length of the drying zone as viewed in said direction of web travel.

7. The method of claim 1, wherein the fibrous web is treated with steam only within the first quarter of the total length of the drying zone as viewed in said direction of web travel.

8. The method of claim 7, wherein the fibrous web is treated with steam substantially over the first quarter of the total length of the drying zone as viewed in said direction of web travel.

9. The method of claim 1, wherein the fibrous web is treated with steam only at a beginning of the drying zone as viewed in said direction of web travel.

10. The method of claim 1, wherein the fibrous web encounters the hot air coming from said hot air hood over at least a portion of the pre-defined drying zone.

11. The method of claim 10, wherein the fibrous web is treated in at least some areas simultaneously with hot air and with steam as viewed in a direction of web travel.

12. The method of claim 1, further comprising the step of carrying the fibrous web through the drying zone together with a permeable fabric, said permeable fabric being one of a structured fabric and a through air drying (TAD) fabric, and at least one of the hot air and the steam flowing first through the fibrous web and subsequently through said permeable fabric.

13. The method of claim 1, further comprising the step of carrying the fibrous web through the drying zone together with at least one permeable fabric, said permeable fabric including a structured fabric, at least one of the hot air and the steam flowing initially through said permeable fabric and subsequently through the fibrous web.

14. The method of claim 13, further comprising the step of additionally covering the fibrous web in the drying zone by at least one additional permeable fabric in the form of a press belt, at least one of the hot air and the steam flow initially through the additional permeable fabric, subsequently through the at least one permeable fabric and finally through the fibrous web.

15. The method of claim 14, further comprising the step of running a dewatering fabric in the form of a felt through the drying zone together with the fibrous web, the at least one of the hot air and the steam initially flowing through the additional permeable fabric, subsequently through the at least one permeable fabric, subsequently through the fibrous web and finally through the dewatering fabric.

16. The method of claim 1, further comprising the step of subjecting the fibrous web in at least in some areas in the drying zone to impingement drying.

17. The method of claim 1, further comprising the step of subjecting the fibrous web in at least in some areas in the drying zone to through-air drying.

18. An apparatus for drying a moving fibrous web, the fibrous web including one of a paper web, a cardboard web and a tissue web, the apparatus comprising:

a hot air hood proximate to the moving fibrous web, the fibrous web moving in a direction of web travel;

at least one suction equipped device proximate to the moving fibrous web; and a drying zone being defined as where the moving fibrous web is treated with hot air from said hot air hood and with steam, the steam being applied within said hot air hood, said drying zone incorporating a sucking zone of said suction equipped device, the apparatus having a steam blow device within said hot air hood configured to treat the fibrous web with the steam inside said drying zone prior to the moving fibrous web being treated with hot air from said hot air hood in the direction of web travel, the drying zone has a total length, the steam blow device being configured to treat the fibrous web as viewed in the direction of web travel with steam within a first half of the total length, the steam blow device being further configured to treat the fibrous web with steam at the beginning of the drying zone as viewed in the direction of web travel.

19. The apparatus of claim 18, wherein said hot air hood and the steam blow device are further configured to initially treat the fibrous web with steam and subsequently with hot air as viewed in the direction of web travel.

20. The apparatus of claim 18, wherein the drying zone has a total length, said hot air hood and the steam blow device being configured to treat the fibrous web as viewed in a direction of web travel with steam over substantially the total length.

21. The apparatus of claim 18, wherein the drying zone has a total length, the apparatus being configured to treat the fibrous web with steam substantially only within a first half of the total length as viewed in a direction of web travel.

22. The apparatus of claim 18, wherein the drying zone has a total length, the steam blow device being configured to treat the fibrous web with steam within only a first third of the total length as viewed in a direction of web travel.

23. The apparatus of claim 22, wherein the steam blow device is further configured to treat the fibrous web with steam substantially over the first third of the total length of the drying zone as viewed in the direction of web travel.

24. The apparatus of the claim 18, wherein the drying zone has a total length, the steam blow device being configured to treat the fibrous web with steam within only a first quarter of the total length as viewed in a direction of web travel.

25. The apparatus of claim 24, wherein the steam blow device is further configured to treat the fibrous web with steam substantially over the first quarter of the total length of the drying zone as viewed in the direction of web travel.

26. The apparatus of the claim 18, wherein the drying zone has a total length, the apparatus being configured to treat the fibrous web with steam only at the beginning of the total length as viewed in a direction of web travel.

27. The apparatus of claim 18, wherein the apparatus is further configured to treat the fibrous web with hot air over a pre-determinable drying zone.

28. The apparatus of claim 18, wherein the apparatus is further configured to treat the fibrous web in some areas simultaneously with hot air and with steam.

29. The apparatus of claim 18, further comprising a permeable fabric, said permeable fabric being one of a structured fabric and a TAD-fabric, the fibrous web being carried through the drying zone together with said permeable fabric with at least one of hot air and steam flowing first through the fibrous web and subsequently through the permeable fabric.

30. The apparatus of claim 18, further comprising at least one permeable fabric, said permeable fabric being a structured fabric, the fibrous web being carried through the drying zone together with said permeable fabric, at least one of hot air and steam flowing initially through said permeable fabric and subsequently through the fibrous web.

31. The apparatus of claim 30, further comprising at least one additional permeable fabric, said at least one additional permeable fabric including a press belt, the fibrous web being covered by said at least one additional permeable fabric in the drying zone, at least one of hot air and steam flowing initially through said at least one additional permeable fabric, subsequently through said at least one permeable fabric and subsequently through the fibrous web.

32. The apparatus of claim 31, further comprising a dewatering fabric, said dewatering fabric being a felt, said dewatering fabric being additionally carried through the drying zone together with the fibrous web, whereby at least one of hot air and steam initially flow through said additional permeable fabric, subsequently through said at least one permeable fabric, subsequently through the fibrous web and finally through said dewatering fabric.

33. The apparatus of claim 18, wherein said steam blow device is at least one of a steam blow pipe and a steam blow box.

34. The apparatus of claim 33, wherein said steam blow device extends substantially over an entire width of said hot air hood as measured across a direction of web travel.

35. The apparatus of claim 33, wherein said steam blow device is located at least partially inside said hot air hood.

36. The apparatus of claim 33, wherein said steam blow device is located directly before said hot air hood as viewed in a direction of web travel.

37. The apparatus of claim 33, wherein said steam blow device includes at least one steam blow pipe with orifices, said orifices having a diameter in a range of approximately 5 to approximately 1 mm.

38. The apparatus of claim 37 wherein said diameter is in a range of approximately 4 to approximately 2.5 mm.

39. The apparatus of claim 33, further comprising at least one permeable fabric covering the fibrous web in the area of the drying zone, a distance between said steam blow device and said permeable fabric covering the fibrous web being <30 mm.

40. The apparatus of claim 39, wherein said distance is <20 mm.

41. The apparatus of claim 40, wherein said distance is <15 mm.

42. The apparatus of claim 41, wherein said distance is ≦10 mm.

43. The apparatus of claim 33, wherein said steam blow device includes at least one steam blow pipe with orifices located from each other at a distance of <20 mm.

44. The apparatus of claim 43, wherein said distance is <10 mm.

45. The apparatus of claim 44, wherein said distance is <7.5 mm.

46. The apparatus of claim 33, wherein said steam blow device includes at least one steam blow box, said at least one steam blow box being configured to at least one of adjust and regulate a moisture profile of the fibrous web.

47. The apparatus of claim 33, wherein said steam blow device includes at least one steam blow pipe, said at least one steam blow pipe being configured to at least one of influence, adjust and regulate a dry content of the fibrous web.

48. The apparatus of claim 18, further comprising:

a drying cylinder including a Yankee cylinder; and a hood associated with said drying cylinder, the hot air for the hot air hood being taken at least partially from the hood associated with said drying cylinder.

49. The apparatus of claim 48, wherein the apparatus and said hood associated with said drying cylinder are configured to take the hot air from said hood associated with said drying cylinder at a temperature of approximately 300° C.

50. The apparatus of claim 48, wherein said hot air hood associated with said drying zone is configured to be supplied at least partially with hot air having a temperature of <250° C.

51. The apparatus of claim 50, wherein said temperature is <200° C.

52. The apparatus of claim 51, wherein said temperature is in a range of approximately 150° C. to approximately 200° C.

53. The apparatus of claim 18, wherein said at least one suction equipped device being at least one of a suction box and a suction roll, said at least one suction equipped device being located in an area of said drying zone on a side of the fibrous web facing away from said hot air hood.

54. The apparatus of claim 53, wherein said suction equipped device is a suction roll with a suction box that defines the suction zone.

55. The apparatus of claim 54, further comprising a permeable fabric in the form of a press belt which is configured to operate under a high tension in a range of approximately 40 to approximately 60 kN/m thereby exerting a pressing pressure on the fibrous web in a press zone in a range of approximately 0.5 to approximately 1.5 bar.

56. The apparatus of claim 55, wherein said press zone has a length as viewed in a direction of web travel, said press zone being formed by said press belt, is defined as substantially an area over which said press belt wraps around said suction roll.

57. The apparatus of claim 56, wherein said length of said press zone substantially corresponds to a length of said suction zone of said suction roll.

58. The apparatus of claim 57, wherein said drying zone as viewed in the direction of web travel is smaller than said press zone.

59. The apparatus of claim 57, wherein said drying zone as viewed in the direction of web travel is one of the same length and longer than said press zone.

60. The apparatus of claim 18, wherein the apparatus is configured to provide the steam having a steam throughput volume (1/min.) that is less than a hot air throughput volume (1/min.) of the hot air.

61. The apparatus of claim 60, wherein the apparatus is further configured to provide the steam at atmospheric pressure with the steam throughput volume being less than 0.5 times the hot air throughput volume.

62. The apparatus of claim 61, wherein the steam throughput volume is less than 0.3 times the hot air throughput volume.

63. The apparatus of claim 62, wherein the steam throughput volume is less than 0.2 times the hot air throughput volume.

64. The apparatus of claim 60, wherein the hot air has a temperature, the temperature of the hot air treating the fibrous web being adjustable for influencing the condensation of the steam in the fibrous web.

65. The apparatus of claim 60, further comprising a permeable belt covering the fibrous web in the drying zone, said permeable belt having a permeability of >100 cfm.

66. The apparatus of claim 65, wherein said permeability is >300 cfm.

67. The apparatus of claim 66, wherein said permeability is >500 cfm.

68. The apparatus of claim 67, wherein said permeability is >700 cfm.

69. The apparatus of claim 60, further comprising a permeable structured fabric moving with the fibrous web through the drying zone, said permeable structured fabric having a permeability of >100 cfm.

70. The apparatus of claim 69, wherein said permeability is >300 cfm.

71. The apparatus of claim 70, wherein said permeability is >500 cfm.

72. The apparatus of claim 71, wherein said permeability is >700 cfm.

73. The apparatus of claim 18, further comprising a permeable press belt that covers the fibrous web in the drying zone, said permeable press belt consisting of a synthetic material, said synthetic material being one of polyamide, polyethylene and polyurethane.

74. The apparatus of claim 18, further comprising a permeable press belt that covers the fibrous web in the drying zone, said permeable press belt being a metal fabric.

75. The apparatus of claim 18, further comprising at least one fabric which is routed through the drying zone together with the fibrous web, the apparatus being configured to pre-heat said at least one fabric before the drying zone when viewed in said direction of web travel.

76. The apparatus according to claim 75, further comprising a pre-heating device configured to pre-heat said at least one fabric, said pre-heating device being at least one of a steam heating device, an IR heating device and a hot water heating device.

77. The apparatus of claim 75, further comprising a pre-heating device configured to pre-heat said at least one fabric, said at least one fabric being a dewatering fabric, said pre-heating device being a hot water heating device, said dewatering fabric being pre-heated with said hot water heating device.

78. An apparatus for drying a moving fibrous web, the fibrous web including one of a paper web, a cardboard web and a tissue web, the apparatus comprising:

a hot air hood proximate to the moving fibrous web;

a suction device proximate to the moving fibrous web;

a drying zone being defined as where the moving fibrous web is treated with hot air from said hot air hood, said drying zone extending through a sucking zone of said suction device, the apparatus including a steam blow device configured to treat the fibrous web with steam in at least some areas inside said drying zone;

at least one permeable fabric, the fibrous web being covered by said at least one permeable fabric in the area of the drying zone; and a doctor blade positioned to remove an air boundary layer that is carried along by said at least one permeable fabric which covers the fibrous web before said at least one permeable fabric enters the drying area, the fibrous web being treated with steam within a first half of a total length of the drying zone in a direction of web travel, the fibrous web being treated with steam from within said hot air hood at least at a beginning of the drying zone relative to said direction of web travel.

79. A machine to produce a tissue web, comprising a drying apparatus having a drying zone where a moving fibrous web is treated with hot air, said drying apparatus including:

a hot air hood defining the drying zone; and a suction device associated with the drying zone, the drying zone being defined as where the web is treated with hot air from said hot air hood, said drying zone extending through a sucking zone of said suction device, the apparatus being configured to treat the fibrous web with steam in at least some areas inside said drying zone;

at least one permeable fabric, the web being covered by said at least one permeable fabric in the area of the drying zone; and a doctor blade positioned to remove an air boundary layer that is carried along by said at least one permeable fabric which covers the web before said at least one permeable fabric enters the drying zone, the fibrous web being treated with steam within a first half of a total length of the drying zone in a direction of web travel, the fibrous web being treated with steam at least at a beginning of the drying zone relative to said direction of web travel.

* * * * *